United States Patent [19]

Neal

[11] Patent Number: 4,967,433

[45] Date of Patent: Nov. 6, 1990

[54] FOAM BODY SUPPORT MEMBER HAVING ELONGATED CHEVRON-SHAPED CONVOLUTIONS

[75] Inventor: Charles O. Neal, Knoxville, Tenn.

[73] Assignee: DeRoyal Industries, Inc., Powell, Tenn.

[21] Appl. No.: 353,104

[22] Filed: May 17, 1989

[51] Int. Cl.[5] ..... A47C 27/14

[52] U.S. Cl. ..... 5/481; 5/468

[58] Field of Search ..... 5/431, 461, 468, 481, 5/464, 446, 443; 297/DIG. 1; 428/159, 160, 182, 183

[56] References Cited

U.S. PATENT DOCUMENTS

| | | | |
|---|---|---|---|
| 2,184,808 | 12/1939 | Belian | 5/468 |
| 3,258,791 | 7/1956 | Kaplan | 5/347 |
| 2,788,061 | 4/1957 | Pedrocchi | 5/481 |
| 2,948,334 | 8/1960 | Goldstein | 5/468 |
| 3,026,544 | 3/1962 | Persicke et al. | 5/361 |
| 3,197,357 | 7/1965 | Schulpen | 161/116 |
| 3,693,619 | 9/1972 | Williams | 128/149 |
| 4,064,578 | 12/1977 | Yamada | 5/355 |
| 4,104,746 | 8/1978 | Goetz | 5/443 |
| 4,205,880 | 3/1979 | Trotman et al. | 297/453 |
| 4,603,445 | 8/1986 | Spann | 5/481 |
| 4,620,337 | 11/1986 | Williams et al. | 5/464 |
| 4,686,725 | 8/1987 | Mitchell | 5/468 |
| 4,700,447 | 10/1987 | Spann | 29/418 |
| 4,741,058 | 5/1988 | Williams et al. | 5/468 |
| 4,796,316 | 1/1989 | Boselli | 5/468 |

FOREIGN PATENT DOCUMENTS

| | | | |
|---|---|---|---|
| 62915 | 4/1982 | European Pat. Off. | 5/468 |
| 453673 | 6/1968 | Switzerland | 5/481 |

*Primary Examiner*—Gary L. Smith
*Assistant Examiner*—F. Saether
*Attorney, Agent, or Firm*—Luedeka, Hodges & Neely

[57] ABSTRACT

A body support member fabricated of an open-cell polyurethane foam sheet, such sheet having a plurality of chevron-shaped ridges projecting from one flat surface of the sheet and extending between opposite side edges of the sheet. Each chevron-shaped ridge has a single bend therein along its length dimension, such bend occurring at the approximate mid-point of such length dimension. The ridges alternate with similarly shaped valleys so that substantially one entire surface of the sheet is made up of such alternating ridges and valleys. The preferred ridges are of a hyperbolic geometry in cross section. The height of each ridge above the surface of the sheet, and the spacing between adjacent ridges preferably are selected to provide the desired support of the body member above the surface. Deflection of the ridges due to body pressure applied there against deforms the ridges causing adjacent ridges to contact one another and provide an infinitely increasing degree of resistance to collapse of the ridge, hence support of the body member. The bent ridges develop air circulation channels along the valleys as the ridges contact one another.

11 Claims, 2 Drawing Sheets

FOAM BODY SUPPORT MEMBER HAVING ELONGATED CHEVRON-SHAPED CONVOLUTIONS

FIELD OF THE INVENTION

This invention relates to foam sheets, i.e. pads, useful in providing support for all or part of a body member, such as when a patient is disposed in a hospital bed. The pad of the present invention is also useful as the base material for fabricating body component support devices such as heel or elbow protectors.

BACKGROUND OF THE INVENTION

Foam sheets, or pads, have long been used as whole body supports for bed patients, the pad being overlaid upon a bed mattress and thereafter covered with a textile sheet. These pads have been shown to be effective in aiding in the prevention of decubitus ulcers which appear to be the result of adverse combinations of heat, moisture, pressure and/or shear between a body member, such as a bony protuberance, and a supporting surface. The prior art foam pads provide a limited degree of aeration to the patient and commonly are formed with a plurality of conical peaks spaced apart from one another over the supporting surface of the pad, such peaks alternating with valleys therebetween. Albeit that such pads have been found useful, they suffer from well known deficiencies such as the tendency of the peaks to collapse and thereby cut off the desired aeration between the body member and the pad. Further, when these peaks collapse, the pad becomes little more than a flat surface so that there is developed a tendency toward shear forces between the body member and the pad, which combined with the lack of aeration, promotes decubitii.

Collapse of the peaks of the prior art pads is felt to be a function of their geometry, as well as the physical characteristics of the foam, i.e. its density, etc. Specifically, the peaks of the prior art must be of substantial respective heights in order for them to be effective as supports and maintain the body member away from the flat base of the pad if aeration is to occur. In foam pads of like densities, the higher peaks tend to collapse more readily and such collapse tends to be more complete, that is, the peaks tend to bend until they are in contact with the base as opposed to shorter peaks tending to compress and bend simultaneously so that the shorter peaks continue to provide a degree of separation of the body member from the base of the pad. Shorter peaks, however, are less comfortable to the patient and tend to develop substantial pressure points where the shear effect can come into play and promote decubitii.

SUMMARY OF THE INVENTION

In accordance with the present invention, there is provided a body support member fabricated of an open-cellepolyurethane foam sheet, such sheet having a plurality of chevron-shaped ridges extending between opposite side edges of the sheet, each chevron-shaped ridge having a single bend therein along its length dimension, such bend occurring at the approximate midpoint of such length dimension. These ridges alternate with similarly shaped valleys so that substantially one entire surface of the sheet is made up of such alternating ridges and valleys.

The preferred ridge is of a hyperbolic geometry in cross-section, such geometry being constant along the length of the ridge. In this preferred embodiment, each valley is of like, but reverse, geometry. The height of each ridge above the surface of the sheet, i.e. above the base of the sheet, the cross-sectional area of each ridge, and the spacing between adjacent ridges preferably are selected to provide the desired support of the body member above the surface, but importantly, because of the integral nature of the ridge, when any portion thereof is subjected to compression in a direction toward the surface of the sheet or to deflection in a direction at an angle to the height dimension of the ridge, there is developed within the ridge a combination of supportive forces that complement one another and provide an infinitely increasing degree of resistance to collapse of the ridge. This combination of supportive forces is particularly evident when the resultant vector of the forces tending to collapse the ridge is directed generally toward the apex of the bend in the ridge. Accordingly, in the present body support member, the apex of such bend of the ridge is preferably oriented with respect to the body support member such that the anticipated forces tending to collapse the ridge are directed principally toward such apex. It has been discovered that when a plurality of chevron-shaped ridges are provided substantially parallel to one another at selected spaced-apart distances, preferably uniform distances, there is further cooperation between the ridges in the form of lateral support against full collapse. This is especially true when the foam sheet is bent, as when it is disposed on a hospital bed mattress and the head portion of the bed is elevated. In this and other instances, when a body member bears against adjacent ridges the several adjacent ridges tend to bend over in the nature of a tree sapling until their respective apex contacts an adjacent ridge and defines an elongated open channel between the ridges and beneath the contact locations between the ridges, thereby retaining aeration between the body member and the surface of the foam sheet. This feature of the present support member is particularly evident when there is a lateral force exerted by the body member against the ridges, such as when a patient has his head elevated and his hips tend to slide down in the bed.

Further, in a preferred embodiment, the depth of the valleys between adjacent ridges is selected to accommodate therein an extremity of a patient, e.g. an arm or leg, and provide gentle and more even support for such extremity.

BRIEF DESCRIPTION OF THE DRAWINGS

Accordingly, it is an object of the present invention to provide a body support member which provides good support with a reduced tendency for developing certain of those conditions that are conducive to reduced comfort or adverse anatomical conditions. It is another object of the present invention to provide a polyurethane foam body support member that is suitable for forming into various configurations for specific support needs. Other objects and advantages of the invention will be recognized from the description contained herein and including the drawings in which.

DETAILED DESCRIPTION OF THE INVENTION

Figure 1:
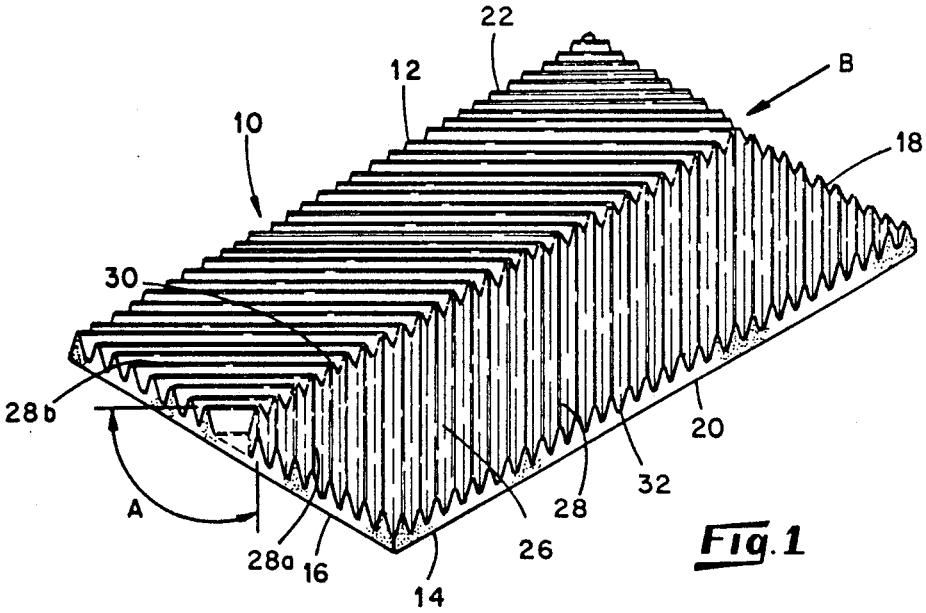
FIG. 1 is a representation of a body support member in accordance with the present invention and incorporated into the form of an elongated, generally flat, pad, such as a bed mattress pad overlay.

With specific reference to the several Figures, a body support member 10 in accordance with the present invention comprises an elongated, generally flat, sheet 12 having a base 14, opposite ends 16 and 18, opposite side edges 20 and 22, a bottom surface 24 which is generally smooth, and a top surface indicated generally at 26. The top surface 26 of the sheet 12 is provided with a plurality of elongated chevron-shaped ridges 28, each of which preferably extends between the opposite side edges 20 and 22 of the sheet and each of which preferably is provided with a single bend 30 at a location that is the approximate midpoint of the length dimension of the ridge and which divides each ridge into lateral wing portions **28*a* and 28*b*. The several ridges 28 project substantially normally from the base 14 and are separated by valleys 32** such that the ridges and valleys alternate along that dimension of the sheet between its opposite ends.

The sheet 12 of the present invention is fabricated preferably of an open-celled polyurethane foam. Such foam is formed in rectangular sheets and subsequently processed through a convoluter such as is well known in the art and described in U.S. Pat. Nos. 3,197,357, 4,603,445 and 4,700,447, the descriptive matter of which is incorporated herein by reference. Suitable foams for the present body support member have a density of not less than about 1.3 lb/ft$^3$ and more preferably about 1.5 lb/ft.$^3$. More dense foams may be employed, e.g. up to about 5 lb/ft$^3$, but at increased cost. The preferred foam has an Indention Load Deflection (ILD) value in excess of about 37 lbs. at 25% deformation, and most preferably about 42 lbs, a tensile strength of at least about 12 psi, a tear resistance of at least about 1.5 PLI (pounds per linear inch), and a compression set of not more than about 10% at 90% deformation. For reasons of safety, the preferred foam has incorporated therein a fire retardant, such as boron or boron-containing compound. As desired, coloring may be supplied to the foam during its manufacture.

Figure 2:
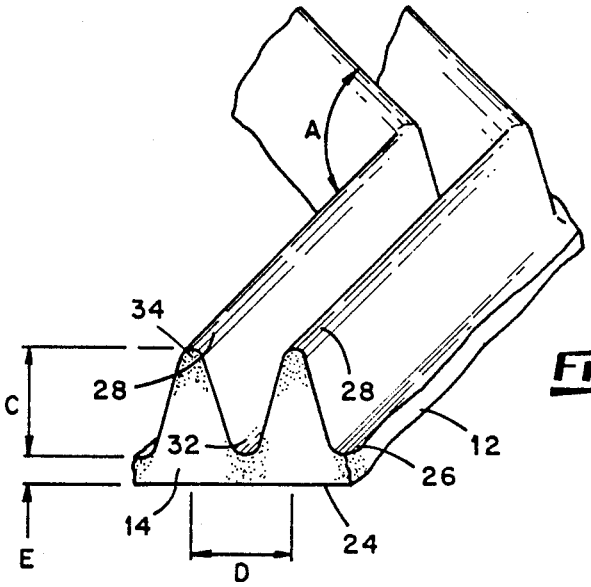
FIG. 2 is a detailed view of a portion of the pad depicted in FIG. 1.
Figure 4:
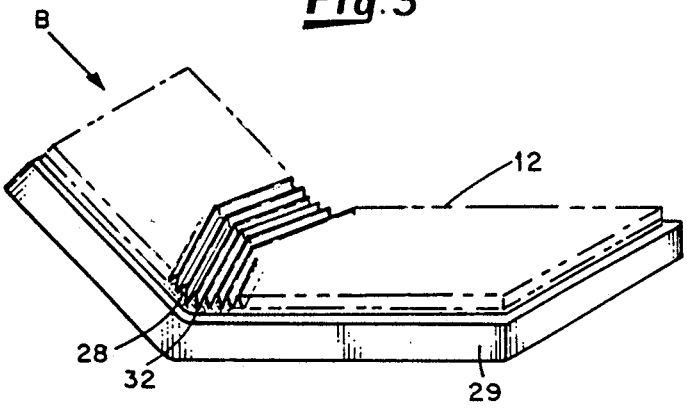
FIG. 4 is a representation of a body support member in accordance with the present invention employed as an overlay on a hospital bed mattress and with the head portion of the bed in an elevated position.

In FIGS. 1 and 4, the body support member of the present invention is depicted in the form of a pad to be used as an overlay for the mattress of a hospital bed 29, for example. FIG. 2 is a detailed view of a portion of the pad depicted in FIG. 1. In this preferred embodiment, it may be seen that the ridges 28 are provided over substantially the entire upper surface 26 of the pad 12, with each chevron-shaped ridge extending between the opposite side edges of the pad. Each ridge is of a substantially hyperbolic geometry when viewed in cross-section and extends above the top surface 26 of the base 14 a height distance C (FIG. 2) of between about 3 inches and about 4 inches, and preferably about 3.5 inches. Each ridge has an average width, in cross-section, of between about 0.75 inch and about 1.5 inch, preferably about 1 inch. The peaks 34 of the several ridges are spaced apart by a distance D of between about 1.5 and about 2.5 inches, preferably about 2 inches. The distal end, i.e. peak 34, preferably is rounded with a radius of about ⅜ inch. The thickness of the pad base E is chosen to provide adequate support for the ridges, and preferably is not less than about 1 inch.

For reasons of mutual support between adjacent ridges against collapse of the ridges, it has been found beneficial to space the ridges apart from one another by a distance that causes the peak region of a ridge which is bent laterally due to the imposition of a lateral force (see arrow "B" of FIG. 1) thereagainst, to come into contact with an adjacent ridge before the bending or collapse of the ridge is complete. Thus, to provide the peak-to-peak spacing between adjacent ridges, the height of a ridge (as measured in a direction normal to the plane of the base) above the base is chosen to provide a peak height to peak-to-peak spacing ratio of between about 1.5 and about 1.8, preferably about 1.75. Within this range of ratios, a ridge which is bent will contact an adjacent ridge before the bonding ridge can contact the base, thereby receiving reinforcement from its adjacent ridge against collapse. In certain instances, such as when the support member is used as a mattress pad and is bent when the bed is adjusted to raise the patient's head, there is a domino effect in reverse; that is, as one ridge tends to collapse, it comes into supporting engagement with an adjacent ridge, and as the force tending to collapse these two ridges increases, the second ridge contacts a third ridge and so on, to provide infinitely increasingly greater resistance to collapse. As noted hereinbefore, this contact between adjacent peaks also serves to develop aeration channels.

The angle of bend, designated "A" in the Figures, in each ridge is selected to maximize the desired cooperative support features described herein and may range between about 45 and 135 degrees, and preferably is about 80 degrees. Greater angles of bend cause the ridges to act like straight ridges with no, or little directionality of support, and lesser, more sharp, angles of bend tend to cause the lateral wing portions **28*a* and 28*b*** to approach parallelism therebetween and to act as straight, but short, ridges.

In use, the present body support member is oriented beneath the body member to be supported with the apexes of the several ridges oriented toward the anticipated direction of the shear forces to be exerted by the body member against the ridges. That is, in accordance with the present invention, the maximum support and retention of the desirable aeration properties of the support member are attainable when the vectors of the forces tending to collapse the ridges, have a resultant that is directed against the ridges in a direction that is substantially parallel to that axis which passes through the aligned apexes of the ridges when viewing the support member from above as in FIGS. 1 and 4 (see arrow "B"). It has been found that this feature of the present body support member remains true even though the resultant force directed against the ridges is localized to one side of the apexes and is directed generally against the wing portions of the ridges and laterally of apexes. It is not known with certainty why such , but it has been discovered that when the forces tending to collapse the ridges are exerted in a direction "into" the bends of the ridges, (i.e. in a direction opposite to the arrow B of FIG. 1) the ridges tend to "roll over" upon themselves and provide less comfortable and less desirable support for the body member. Accordingly, when the present body support is employed as a pad on a bed mattress, the apexes of the several ridges are oriented toward the head of the bed, inasmuch as it is most common for the patient in a bed to tend to slide down, i.e. toward the foot of the bed. In this manner, the present pad provides the maximum of support and aeration for the bed patient. Further, this orientation of the pad on the bed aligns the valley on each side of the apex of a ridge-valley combination at an angle of about 40 degrees with respect to the longitudinal centerline of the bed (and the patient on the bed) so that the patient's arms are readily received in and gently supported within such valley portions. This feature is especially useful when a patient is lying on his side so that his arm is received in the valley and the remainder of his upper body is supported above the arm by the ridges, thereby reducing the likelihood of cutting off circulation through the major blood vessels of the arm. This same feature applies with respect to the patient's leg. Still further, it has been found that the described alignment of the ridge apexes tends to urge the patient toward the center of the bed thereby enhancing body alignment.

By reason of the continuous nature of the ridges of the present body support member, there is provided enhanced vertical support for the body member. It appears that the elongated nature of the ridges provides lateral resistance against collapse of the ridges due to generally vertically downward, i.e. compressive, forces exerted against the ridges as by the weight of a body member supported on the member. The result in any event is enhanced support for the body member as compared to the prior art multiple-peak support members, in addition to the other features as set forth herein.

Figure 3:
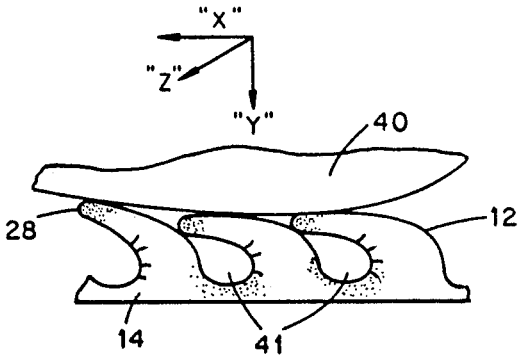
FIG. 3 is a schematic representation showing the deflection and compression of the ridges of a body support member of the type depicted in FIG. 1 when in use to support a body portion.

Promotion of aeration between the body member and the base of the present support member is in part maintained as noted above by reason of the peak-to-peak spacing of the ridges and their height dimension above the surface of the support member. This feature is depicted in FIG. 3 where it is seen that a body member 40 supported on the present support member 12 tends to develop both a vertically downwardly directed force vector, indicated by arrow "Y", and a laterally directed force vector, indicated by the arrow "X", with a resultant vector, indicated by the arrow "Z". The direction of the resultant "Z" is noted to be at an acute angle with respect to the plane of the base 14 of the support member 12 so that the ridges 28 tend to bend laterally until they contact an adjacent ridge. This action produces two results, first, the contact between the ridges tends to provide cooperative support of the ridges against complete collapse, and second, there are developed between the ridges and in the valleys between adjacent ridges, open channels 41 which serve as aeration channels for the transfer of moisture-laden air away from the body member and the replacement thereof with drier fresh air.

Figure 5:
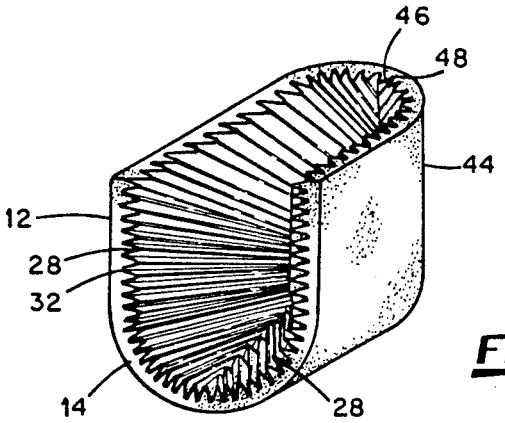
FIG. 5 is a representation of an embodiment of the present body support member incorporated into a support for an elbow or heel.

A further use for the body support member of the present invention is depicted in FIG. 5. In this Figure, there is shown a representation of a heel or elbow protector 44 comprising a flat sheet which has been folded back upon itself with the ridges 28 facing inwardly of the fold, and having one of the sets of mating edges 46 and 48 bonded together to define the cup-shaped protector 44. Notably, in this embodiment, the apexes of the several bent ridges are directed toward the closed end of the member for the reason that the forces from the heel or elbow disposed within the member are anticipated to be in a direction from the closed end of the member toward the open end. Thus, the orientation of the ridges provides the desired maximum support and comfort to the heel or elbow.

Whereas specific embodiments of the invention are shown and described, such are not to be deemed to be limiting in nature except as set forth in the claims appended hereto.

I claim:

1. A body support member fabricated of an open-celled polyurethane foam sheet having a base, a uppermost body contacting surface and first and second side edges, and characterized in that said surface has defined thereon a plurality of substantially parallel elongated chevron-shaped ridges projecting from said surface and alternating with like-shaped valleys wherein said ridges being continuous in length and extending between said side edges with a single bend of each ridge occurring at substantially the midline between said side edges, such that said ridges individually and collectively provide substantially increasing degrees of resistance to collapse thereof.

2. The body support member of claim 1 characterized in that each ridge is of a substantially constant cross-sectional area along its length.

3. The body support member of claim 1 characterized in that said base is of a thickness of not less than about ½ inch.

4. The body support member of claim 1 characterized in that said foam has a density of between about 1.25 and 3.0 lb./in$^2$; and an ILD of not less than about 40 lbs.

5. The body support member of claim 1 characterized in that said ridges are generally of a hyperbolic geometry in cross-section.

6. The body support member of claim 5 characterized in that the peak of each ridge, in crosssection, defines an arc having a radius of about ⅜ inch.

7. The body support member of claim 1 characterized in that each ridge is bent once along its length dimension at an angle of between about 45 and 135 degrees.

8. The body support member of claim 7 characterized in that said bend of said ridge occurs at the approximate midpoint along the length of said ridge.

9. The body support member of claim 8 characterized in that said foam sheet is of a size sufficient to substantially cover a bed mattress and said ridges are oriented with the respective bends thereof pointed in the direction of the head portion of said mattress.

10. The body support member of claim 1 characterized in that said foam sheet is configured into an open-sided L-shape suitable for receiving therein a heel or elbow.

11. A body support member fabricated of an open-celled polyurethane foam sheet having a base, a first uppermost body contacting surface and second generally planar opposite surface, and first and second side edges, and characterized in that one of said first surface has defined thereon a plurality of substantially parallel elongated chevron-shaped ridges alternating with like-shaped valleys, said ridges being continuous in length and extending between said side edges with the single bend of each ridge occurring at substantially the midline between said side edges, said alternating ridges and valleys extending over substantially the entire one surface of said sheet, each ridge projecting from said one surface a distance of at least about 3 inches and having an average cross-sectional width dimension of at least about 1 inch, each ridge having a peak and the peaks between adjacent ridges being spaced apart a distance of between about 1.5 and 2.5 inches whereby said ridges individually and collectively provide substantially infinitely increasing degrees of resistance to collapse thereof.

* * * * *

UNITED STATES PATENT AND TRADEMARK OFFICE

CERTIFICATE OF CORRECTION

PATENT NO. : 4,967,433

DATED : November 6, 1990

INVENTOR(S) : Charles O. Neal

It is certified that error appears in the above-identified patent and that said Letters Patent is hereby corrected as shown below:

Claim 11, Column 6, Line 52

Delete "one of"

Signed and Sealed this

Twenty-first Day of April, 1992

*Attest:*

HARRY F. MANBECK, JR.

*Attesting Officer*

*Commissioner of Patents and Trademarks*